US005778621A

United States Patent [19]

Randjelovic

[11] Patent Number: 5,778,621

[45] Date of Patent: Jul. 14, 1998

[54] SUBFLOORING ASSEMBLY FOR ATHLETIC PLAYING SURFACE AND METHOD OF FORMING THE SAME

[75] Inventor: Erlin A. Randjelovic, Crystal Falls, Mich.

[73] Assignee: Connor/AGA Sports Flooring Corporation, Amasa, Mich.

[21] Appl. No.: 811,700

[22] Filed: Mar. 5, 1997

[51] Int. Cl.[6] ..... E04F 15/22

[52] U.S. Cl. ..... 52/403.1; 52/480; 52/508; 52/376; 52/745.05; 52/781.3

[58] Field of Search ..... 52/403.1, 402, 52/480, 508, 512, 745.05, 781.3, 370, 371, 376

[56] References Cited

U.S. PATENT DOCUMENTS

| | | | |
|---|---|---|---|
| 498,344 | 5/1893 | Williams . | |
| 802,622 | 10/1905 | Van Den Bulcke . | |
| 1,195,289 | 8/1916 | Stevens . | |
| 1,302,578 | 5/1919 | Murphy . | |
| 1,339,425 | 5/1920 | Stevens . | |
| 1,342,610 | 6/1920 | Wheeler . | |
| 1,343,234 | 6/1920 | Stevens . | |
| 1,350,349 | 8/1920 | Walther | 52/402 |
| 1,491,198 | 4/1924 | Cassidy . | |
| 1,587,355 | 1/1926 | Raun . | |
| 1,668,842 | 5/1928 | Dudfield et al. . | |
| 1,692,855 | 11/1928 | Murphy . | |
| 1,693,655 | 12/1928 | Murphy . | |
| 1,752,583 | 4/1930 | Wright . | |
| 1,781,117 | 11/1930 | Mackie et al. . | |
| 1,787,067 | 12/1930 | Eisler . | |
| 1,911,433 | 5/1933 | Cinnamond . | |
| 1,977,496 | 10/1934 | Snyder et al. . | |
| 2,066,005 | 12/1936 | Jenkins | 52/403.1 |
| 2,167,836 | 8/1939 | Greulich . | |
| 2,414,986 | 1/1947 | Tinnerman . | |
| 2,708,781 | 5/1955 | McMullan . | |
| 2,862,255 | 12/1958 | Nelson . | |
| 2,996,160 | 8/1961 | Voight . | |
| 3,045,294 | 7/1962 | Livezey, Jr. . | |
| 3,271,916 | 9/1966 | Omholt . | |
| 3,387,422 | 6/1968 | Wanzer . | |
| 3,398,491 | 8/1968 | Babcock | 52/745.05 X |
| 3,562,990 | 2/1971 | Boettcher . | |
| 3,596,422 | 8/1971 | Boettcher . | |
| 3,786,608 | 1/1974 | Boettcher . | |
| 3,788,021 | 1/1974 | Husler | 52/403.1 |
| 4,170,859 | 10/1979 | Counihan . | |

(List continued on next page.)

FOREIGN PATENT DOCUMENTS

| | | | |
|---|---|---|---|
| 53863 | 11/1937 | Denmark . | |
| 106748 | 1/1899 | Germany | 52/403.1 |

OTHER PUBLICATIONS

Action Floor Systems, Inc. Brochure, 1 p., (undated).

"Bio–Channel™", Brochure, Robbins, Inc., 1 p. (undated).

*Primary Examiner*—Wynn E. Wood
*Assistant Examiner*—Laura A. Callo
*Attorney, Agent, or Firm*—Merchant, Gould, Smith, Edell, Welter & Schmidt, P.A.

[57] ABSTRACT

The present invention provides a subfloor system for placement over a substrate. The subfloor consists of a base, a resilient pad, an upper member, and brackets. The resilient pad is positioned on the base, preferably within an elongated slot formed in the upper surface of the base. The upper member is operably connected to the top surface of the resilient pad. The upper member has a projection and two shoulders. The brackets have an upper and lower tab and are secured to the base and to the upper member. The lower tab is adapted to fit within the base and the upper tab rests on the corresponding shoulder of the upper member. When under load, the resilient pad compresses thereby causing the upper member to move towards the base. The brackets, however, limit vertical movement of the upper member relative to the base. The invention also includes a method of forming a resilient sports floor employing such a subfloor system.

23 Claims, 5 Drawing Sheets

U.S. PATENT DOCUMENTS 4,599,842 7/1986 Counihan .
4,819,932 4/1989 Trotter, Jr. .
4,831,806 5/1989 Niese et al. .
4,856,250 8/1989 Gronau et al. .
4,879,856 11/1989 Jones et al. .
4,879,857 11/1989 Peterson et al. .
4,890,434 1/1990 Niese .
4,930,280 6/1990 Abendroth .
5,016,413 5/1991 Counihan .
5,369,927 12/1994 Counihan .
5,377,471 1/1995 Niese ..... 52/376 X
5,388,380 2/1995 Niese ..... 52/403.1 X
5,475,959 12/1995 Mackenzie ..... 52/403.1
5,497,590 3/1996 Counihan ..... 52/403.1 X
5,647,183 7/1997 Counihan ..... 52/403.1

SUBFLOORING ASSEMBLY FOR ATHLETIC PLAYING SURFACE AND METHOD OF FORMING THE SAME

TECHNICAL FIELD

This invention generally relates to a subfloor system which is placed under a sports floor, and more specifically to a subfloor system which provides a level sports floor with increased stability and resiliency.

BACKGROUND

Sports floors have certain requirements above and beyond floors used for nonathletic purposes. Athletic floors must have some degree of elasticity under load, and yet be quite firmly supported. Further, a sports floor must be uniformly supported and level throughout the entire surface so that there are no dead spots or uneven spots which could affect the activity occurring on the sports floor.

Numerous attempts have been made to design a sports floor with such ideal characteristics. Resiliency is typically obtained by implementing a shock absorbing system into the subfloor. Shock absorbing systems are in wide use in sports flooring installations. Typical systems provide a subfloor of softwood sleepers or plywood sheeting supported by isolated resilient pads. These designs allow deflection under active loads offering shock absorbency of the system to the athletic participant. Reduction of impact forces are beneficial to the participant. Examples of typical shock absorbing systems are disclosed in U.S. Pat. Nos. 4,879,857 to Peterson et al and 4,890,434 to Niese et al. Typically referred to as floating systems, these subfloors are not anchored to the concrete substrate but rather rest on individual resilient pad supports. While these floating systems offer improved resiliency, stability is reduced.

One way to improve stability is to anchor or fasten the sports floor to the underlying concrete substrate. Anchored systems are especially resistant to buckling or upward movement associated with sports floors under changing environmental conditions. However, anchored systems lack the resiliency associated with floating systems. Also, anchored systems suffer from the disadvantage that the concrete substrate must be specially prepared or modified in order to accept and support the anchored fasteners. For example, depending on the type of subfloor used, the concrete has to be set to a specified hardness, aggregate size and type.

Flooring systems have a limited life, and new subfloors are installed over existing substrates rather than replacing them prior to installation of the new system. Such retrofit installations create problems. In retrofit installations, the existing concrete substrates often are severely damaged by left-over components or extended wear. As a result, it is difficult to secure the new subfloor such that the floor is sufficiently stable and level. Replacement installations often require substantial concrete preparation and modification before a new floor system is installed.

Attempts have been made to combine the resiliency of floating systems and the stability of anchored systems. For example, U.S. Pat. No. 4,856,250 to Gronau et al incorporates a suspended sleeper resting on resilient pads. The sleeper and pads are encased by flanges of a steel channel which are secured to a substrate by means of steel concrete anchors. Similarly, U.S. Pat. No. 5,016,413 to Counihan incorporates isolated subfloor panels, typically two (2) plywood layers suspended on a resilient layer. U or T shaped steel channels are secured in a manner to allow outward flanges of the channel to rest upon a lower ridge in the plywood subfloor. The channel is fastened to the substrate by means of concrete anchors. This design allows downward deflection of the subfloor upon athletic impact to provide shock absorbance while preventing upward movement of the subfloor associated with negative moisture affects on wood sports floor systems.

SUMMARY

The present invention provides a subfloor system for placement over a substrate. The subfloor consists of a base, a resilient pad, an upper member, and a bracket. The resilient pad is positioned on the base, preferably within an elongated slot formed in the upper surface of the base. The upper member is operably connected to the top surface of the resilient pad. The upper member has a projection and two shoulders. The bracket has an upper and lower tab and is secured to the base and to the upper member. The lower tab is adapted to fit within the base and the upper tab rests on the corresponding shoulder of the upper member. When under load, the resilient pad compresses thereby causing the upper member to move towards the base. The bracket, however, limits vertical movement of the upper member relative to the base.

The invention also includes a method of forming a resilient sports floor employing such a subfloor system.

DETAILED DESCRIPTION

Figure 1:
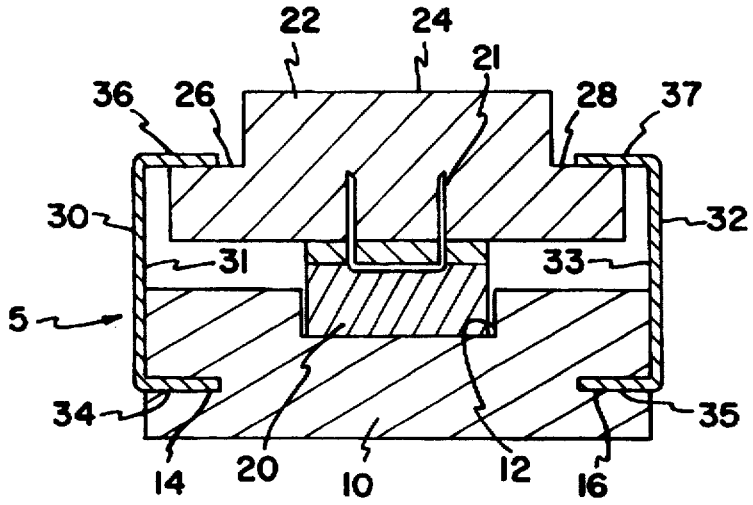
FIG. 1 is a sectional view of a first embodiment of a subfloor sleeper made according to the present invention.

A preferred embodiment of the invention will be described in detail with reference to the drawings, wherein like reference numeral represent like parts and assemblies throughout the several views. Reference to the preferred embodiment does not limit the scope of the invention, which is limited only by the scope of the claims attached hereto.

In general, the present invention relates to a subfloor which is placed under a sports floor. The subfloor rests on a substrate which is typically concrete. The subfloor allows for a level and evenly loaded sports floor which is resilient with a high degree of stability.

Referring now to FIG. 1, the subfloor comprises a sleeper 5, which preferably includes a base 10, a resilient layer made up of resilient pads 20, an upper member 22, and brackets 30 and 32.

The base 10 has a rectangular shaped cross section with a top surface, a bottom surface, and two side surfaces. The top surface of the base 10 defines an elongated slot 12. The slot is parallel to the length of the base 10 and extends the substantial length of the base 10. Each side surface of the base 10 defines a groove 14 and 16. The groove is parallel to the length of the base 10 and extends the substantial length of the base 10. The base 10 is preferably made of wood, which is sufficiently rigid to support the floor, but which is machinable so that the height and profile of the base can be modified, as will be hereinafter described.

The resilient layer, made up of plurality of resilient pads 20, are disposed along the length of the slot 12. The pads 20 lies substantially within the entire slot 12. The pads are resilient and are made of generally compressible, moldable material. A preferred material is urethane, although many other elastomers are acceptable. Rather than employing a number of smaller pads, the resilient layer may also be made up of a single strip of resilient pad material which extends within the slot 12. As another alternative, the slot 12 may be omitted and the base 10 may be bored in selected locations along the top thereof to provide for placement of resilient pads 20.

The upper member 22 is operably connected to the pads 20, preferably by way of staples 21. The upper member 22 has a longitudinal axis which extends substantially parallel to the longitudinal axis of the base 10. The member 22 is shaped so as to have a protrusion 24 and shoulders 26 and 28. The protrusion 24 and shoulders 26 and 28 extend substantially the full length of the member 22. The member 22 is preferably made of rigid material designed to accept typical mechanical fasteners, such as wood.

Brackets 30 and 32 are designed to operably connect the base 10 and the upper member 22. The brackets extend substantially the full length of the base 10. Bracket 30 has an inner surface 31, a lower tab 34, and an upper tab 36. The lower tab 34 is designed to be inserted into groove 14 formed in the side surface of base 10, such that the inner surface 31 of the bracket 30 is substantially flush with the side surface of the base 10. The upper tab 36 is designed such that the inner surface of the tab 36 is proximal to the shoulder 26. Bracket 32 is similar to bracket 30, and has an inner surface 33, a lower tab 35, and an upper tab 37 which interact with the base 10 and the upper member 22 in the same manner. Brackets 30 and 32 are made of sufficiently rigid material so as to firmly secure the member 22 and the body 10, such as steel. The brackets 30 and 32 are preferably held in position tightly to the base 10 by means of machine screws and nuts (not shown) extending through the brackets and base.

Figure 2:
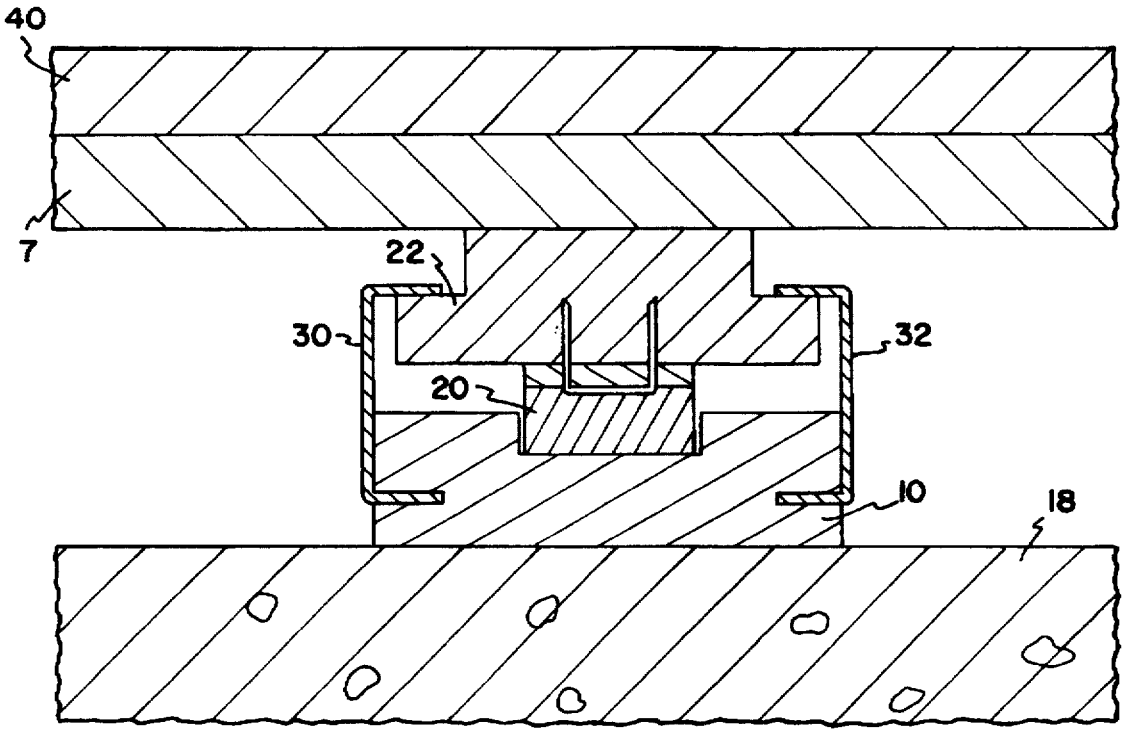
FIG. 2 is a sectional view of a portion of a floor system employing a subfloor made according to the present invention.
Figure 3:
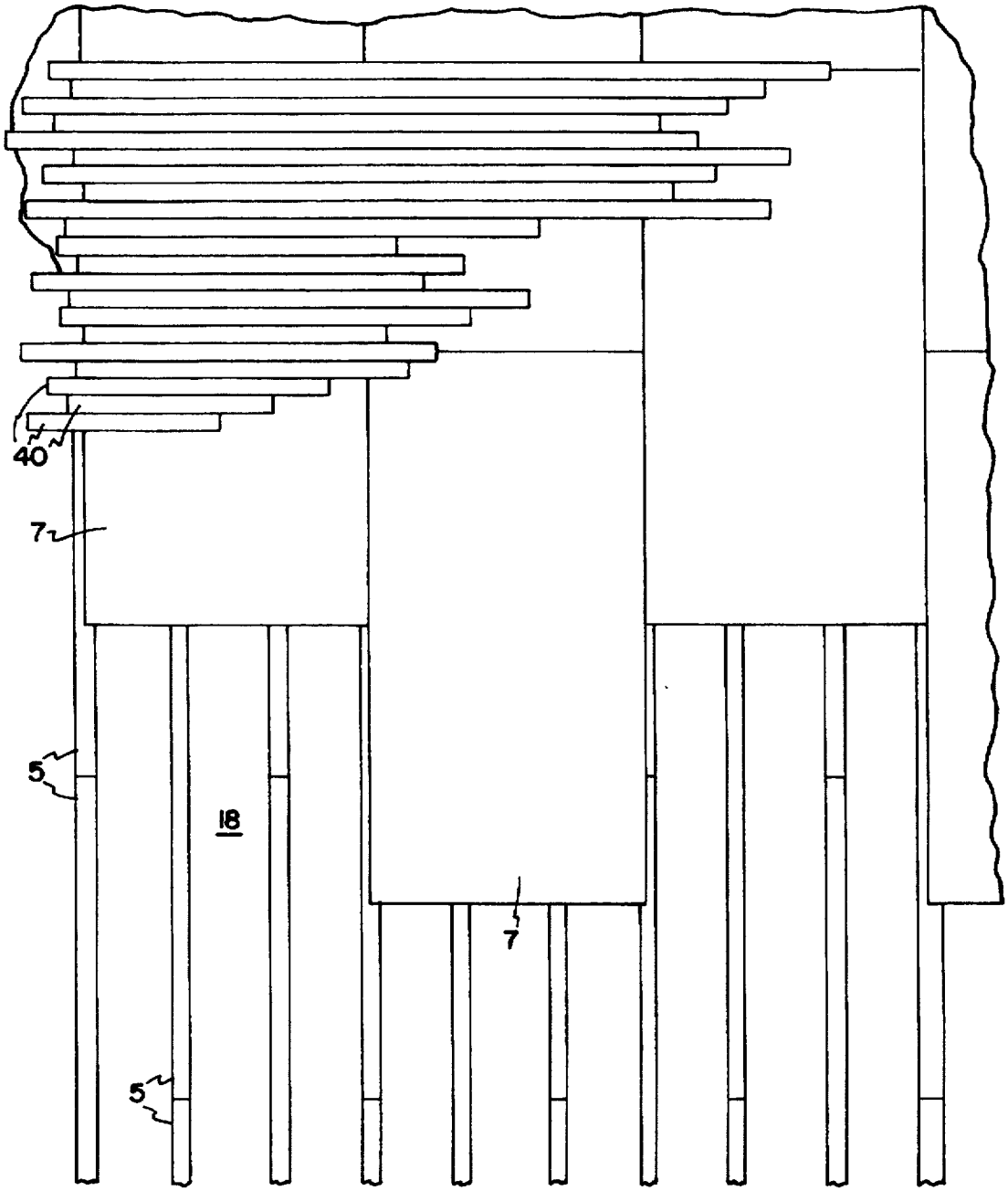
FIG. 3 is a top view showing a flooring system constructed according to the present invention.

A typical floor system with which the subfloor of the present invention can be used is shown in FIGS. 2 and 3. The floor system typically includes a subfloor layer 7 attached to rows of sleepers 5. The sleepers rests upon substrate 18. The subfloor is typically attached to the sleepers by means of staples. Flooring 40 attached to the subfloor. Flooring 40 is generally made of hardwood floor strips which are connected together by a tongue and groove arrangement.

As shown in FIG. 3, flooring strips 40 are placed over the subfloor layer 7, preferably in a direction substantially perpendicular to the subfloor members 5. The flooring 40 is attached to the subfloor in a conventional manner such as staples or nails. The nails are driven into the subfloor layer 7. Alternatively, the subfloor layer may be omitted, such that the flooring 40 is attached directly to the sleepers.

As shown in FIG. 2, substrate 18 is typically a concrete layer or the like. The base 10 of the subfloor rests upon the substrate 18. Mechanical fasteners are not generally needed nor desired, which makes installation easier and more efficient. The substrate 18 does not have to be capable of receiving fasteners which reduces the cost of preparing the substrate 18. However, if desired, a short Z-shaped sectional bracket (not shown) may be periodically placed along the side sections of brackets 30 and 32, and fastened, to the substrate so as to anchor the sleepers to the substrate.

It should be noted that the various components of the subfloor are dimensioned such that the pads 20 are slightly compressed between the base 10 and the upper member 22 even when no load is applied to the floor. This helps to ensure that dead spots are not created on the floor. For installation purposes, the subfloor is preferably preassembled in standard lengths, such as 8 foot sections. Rows of the subfloor sections are placed across the area to be covered, with adjoining rows preferably being spaced approximately 12–18 inches apart.

Figure 4:
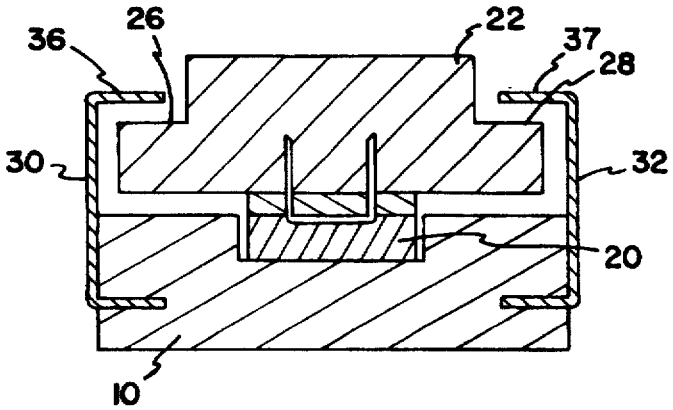
FIG. 4 is a sectional view of the subfloor sleeper of FIG. 1, shown under moderate load conditions.
Figure 5:
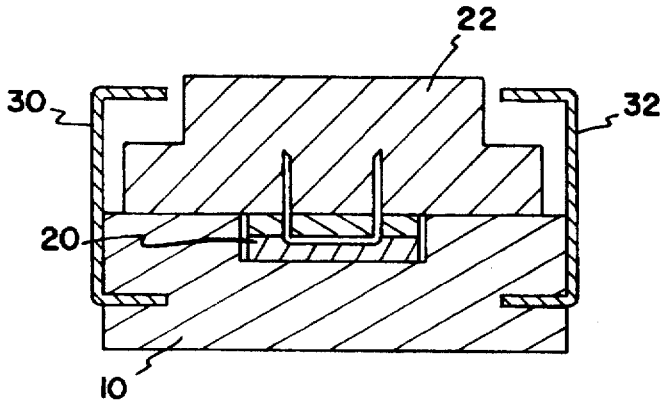
FIG. 5 is a sectional view of the subfloor sleeper of FIG. 1, shown under maximum load conditions.

FIGS. 4 and 5 show the effects of loading on the subfloor sleepers. In FIG. 4, the sleeper is shown under a moderate load. A load applied to the flooring is transmitted through the upper member 22 and to the pad 20. The pad 20 compresses and causes the upper member 22 to move towards the base 10. The shoulders 26 and 28 move away from the corresponding upper tabs 36 and 37.

FIG. 5 shows the effects of heavy loading on the sleepers. The pad 20 is fully compressed. The bottom surface of the upper member 22 contacts the top surface of the base 10. This contact is made possible because the height of slot 12 is greater than the minimum compressed height of the pad 20. This provides the subfloor with a maximum load tolerance past which the floor will no longer flex. This has the further advantage of protecting the pad from excessive loads. Upon removal of the load, the pad 20 decompresses thereby pushing the upper member 22 to the original position.

In some circumstances, it may be desirable for the pad 20 to be made of a hard, substantially non-deformable material, such that the subfloor sleeper does not flex under load. This is advantageous where firm support is necessary such as under bleachers or a stage.

Figure 6:
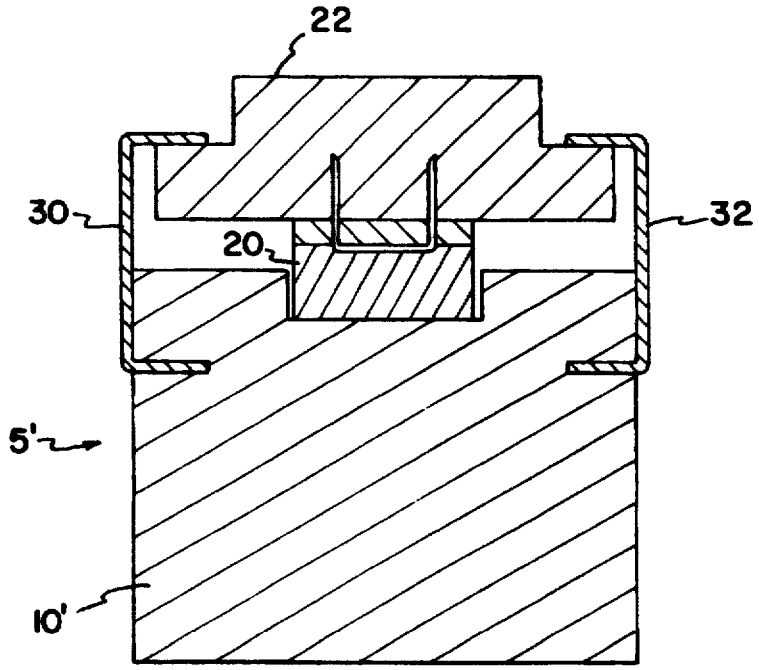
FIG. 6 is a sectional view of an alternative embodiment of a subfloor sleeper made according to the present invention, showing an elevated base.

FIG. 6 shows an alternative embodiment of a sleeper 5' which exemplifies the versatility of the invention provided by having the base made of a machinable material. The various elements of the sleeper shown in this alternative embodiment are the same as those of FIG. 1, except for base 10', which is of an increased height. This increased height permits the subfloor to account for different height requirements such as when the substrate contains an elevated plateau or other deformities. It is contemplated that the base 10 could take on a wide variety of heights.

Figure 7:
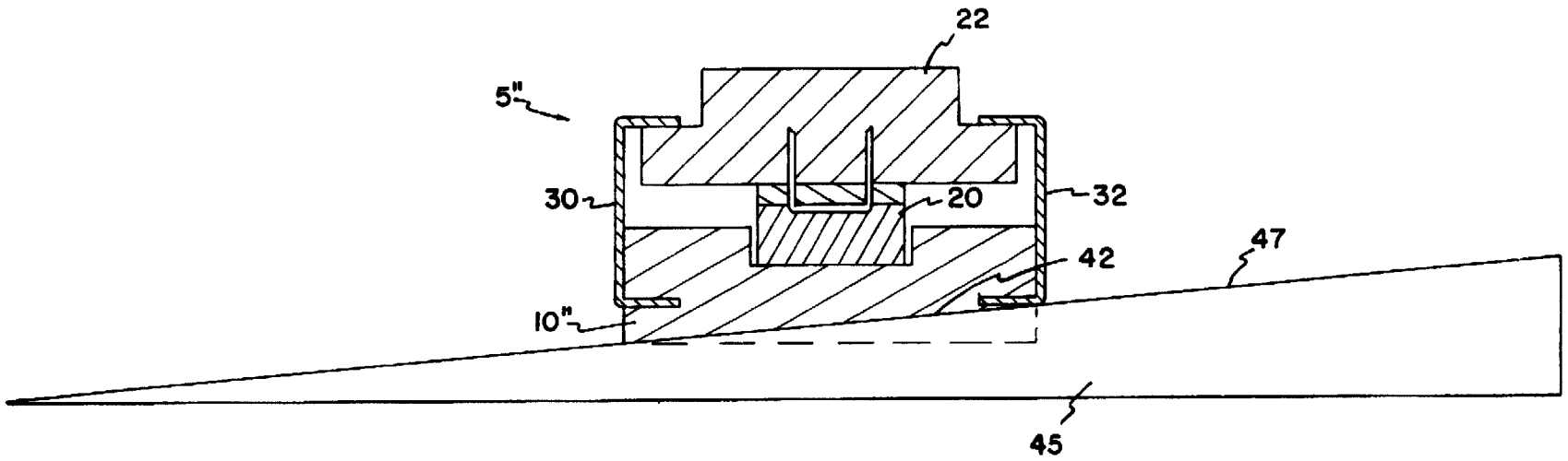
FIG. 7 is a sectional view of an alternative embodiment of a subfloor sleeper made according to the present invention, showing an angled base.

FIG. 7 shows another alternative embodiment of the present invention. Again, the various elements of the sleeper 5" shown in this embodiment are the same as those shown in FIG. 1, except for base 10". In this embodiment, the base 10" is provided with an angled bottom surface 42. Angled bottom surface 42 can extend along the entire length of the base, or alternatively can be in the form of slots located at discrete locations along the bottom of the base. The angled bottom surface 42 is designed to accommodate one or more shims 45, which have an upper angled surface 47 which corresponds to the angle of surface 42. This feature allows the subfloor to be adapted to a wide variety of surfaces. In particular, the shim 45 can be moved transversely relative to the base so as to raise or lower the entire subfloor assembly. This allows the subfloor to easily adapt to variations and imperfections in the substrate.

The base 10" is preferably angled prior to installation. However, in all of the embodiments disclosed herein, further angles, cutouts, or other modifications to the base 10 can be made in order to account for unforeseen deformities in the substrate. This increases the versatility of the system and decreases installation time.

The ability to either angle or otherwise machine the base of the sleeper is particularly advantageous when the subfloor is placed over new concrete construction. As concrete dries, the curing process creates movement in the slab and typically forms ridges at construction joints in the concrete. Normally, these high areas must be ground down prior to installation of the floor system. The present invention, however, allows customizing in the form of sanding or scarfing selected areas in the underside of the base to to allow a continuous flat upper member 22.

Figure 8:
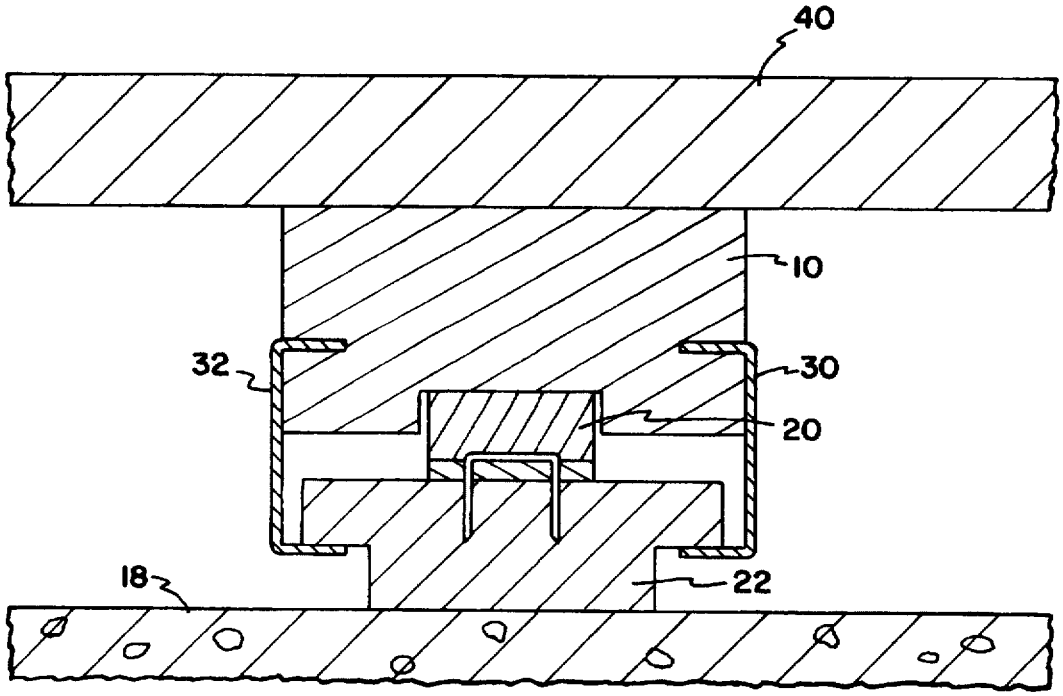
FIG. 8 is a sectional view of an alternative embodiment of a floor system made according to the present invention, where the base is attached to the flooring.

FIG. 8 shows an alternative embodiment of the present invention. The structure and function of this alternative embodiment is the same as the embodiment of FIG. 1, with the exception that the subfloor is rotated 180 degrees along its longitudinal axis. In this embodiment, the top surface of the upper member 22 contacts the substrate 18. The flooring 40 is attached to the base 10. This has the advantage of providing a broader nailing base, which is particularly important when no subfloor layer is provided.

The present invention has many advantageous. One advantage is that the subfloor combines resiliency with stability. The subfloor provides these ideal characteristics under adverse environmental conditions such as high relative humidity or increased flooring moisture content.

Also advantageous is the fact that the subfloor does not require mechanical anchoring to the underlying substrate. As a result, the subfloor is simple and cost effective to install. The ease of installation is appreciated when retrofitting the subfloor to replace an existing sports floor. The subfloor is easily retrofitted to a concrete substrate even though the substrate is damaged or uneven. The ease of installation is advanced by providing a broader base for attaching flooring boards. As a result, less time is needed for applying floor fasteners.

A further advantage of the present invention includes the adjustability of the subfloor to adapt to all types of surfaces. The subfloor allows for simple profile height adjustments to accommodate different height requirements. Also, the subfloor is easily modified to conform to the existing deformities in the concrete.

A further advantage of the present invention includes the adjustability of the resilient characteristics of the sports floor. The subfloor flexes up to a certain maximum limit which ensures that no excessive stress is placed on the subfloor components. In addition, the resiliency is modified where necessary to provide firmer support.

The foregoing constitutes a description of the preferred embodiments of the invention. Numerous modifications are possible without departing from the spirit and scope of the invention. The size and relative dimensions of the various elements can be varied where appropriate. The invention need not be used with the floor system shown in FIG. 2, but can be used with floor systems of various types. Hence, the scope of the invention should be determined with reference, not to the preferred embodiment, but to the appended claims.

The claimed invention is:

1. A subfloor system for placement under a floor comprising:

a base having a top surface, a bottom surface, and two side surfaces;

at least one pad positioned on the base;

an upper member having a top surface and a bottom surface, the top surface having at least one shoulder, and the bottom surface being positioned on the pad; and a bracket having an upper tab and a lower tab, the lower tab adapted to fit within one of the side surfaces of the base, and the upper tab adapted to engage the upper member so as to limit vertical movement of the upper member.

2. The subfloor system of claim 1, wherein the top surface of the base has an elongated slot formed therein, and wherein said at least one pad is disposed substantially within the elongated slot.

3. The subfloor system of claim 1 wherein the upper member has first and second shoulders formed adjacent opposing side walls thereof, and wherein the bracket engages the first shoulder of the upper member, the subfloor system further comprising a second bracket having an upper tab and a lower tab, the lower tab adapted to fit within the other side surface of the base, and the upper tab adapted to engage the second shoulder so as to limit vertical movement of the upper member.

4. The subfloor system of claim 1 wherein the pad is formed from resilient material.

5. The subfloor system of claim 1 wherein the base is formed from wooden material.

6. The subfloor system of claim 1 wherein the bottom surface of the base extends substantially parallel to the top surface of the upper member.

7. The subfloor system of claim 1 wherein the bottom surface of the base extends at an angle relative to the top surface of the upper member.

8. The subfloor system of claim 1 wherein the upper member is adapted to attach to the floor.

9. The subfloor system of claim 1 wherein the base is adapted to attach to the floor.

10. A flooring system to be placed over a substrate, comprising:

a plurality of subfloor members placed over the substrate and extending substantially in parallel to each other, each of said subfloor members comprising:

a base having a top surface, a bottom surface, and two side surfaces;

at least one pad positioned on the base;

an upper member having a top surface and a bottom surface, the top surface having at least one shoulder, and the bottom surface being positioned on the pad; and a bracket having an upper tab and a lower tab, the lower tab adapted to fit within one of the side surfaces of the base, and the upper tab adapted to engage the upper member so as to limit vertical movement of the upper member; and a plurality of flooring strips extending across the subfloor members and attached thereto.

11. The flooring system of claim 10, wherein the top surface of the base of each subfloor member has an elongated slot formed therein for receiving the at least one pad.

12. The flooring system of claim 10 wherein the upper member of each subfloor member has first and second shoulders formed adjacent opposing side walls thereof, and wherein the bracket of each subfloor member engages the first shoulder of the upper member, each of the subfloor members further comprising a second bracket having an upper tab and a lower tab, the lower tab adapted to fit within the other side surface of the base, and the upper tab adapted to engage the second shoulder so as to limit vertical movement of the upper member.

13. The flooring system of claim 10 wherein the at least one pad of each subfloor member is formed from resilient material.

14. The flooring system of claim 10 wherein the base of each subfloor member is formed from wooden material.

15. The flooring system of claim 10 wherein the bottom surface of the base of each subfloor member extends substantially parallel to the top surface of the upper member.

16. The flooring system of claim 10 wherein the bottom surface of the base of each subfloor member extends at an angle relative to the top surface of the upper member.

17. The flooring system of claim 10 wherein the upper members of the subfloor members are attached to the flooring strips.

18. The flooring system of claim 10 wherein the bases of the subfloor members are attached to the flooring strips.

19. A method of forming a flooring system over a substrate, comprising:

placing a plurality of subfloor members substantially in parallel to each other over the substrate, each of said subfloor members comprising:

a base having a top surface, a bottom surface, and two side surfaces;

at least one pad positioned on the base;

an upper member having a top surface and a bottom surface, the top surface having at least one shoulder, and the bottom surface being positioned on the resilient pad; and a bracket having an upper tab and a lower tab, the lower tab adapted to fit within one of the side surfaces of the base, and the upper tab adapted to engage the upper member so as to limit vertical movement of the upper member; and placing a plurality of flooring strips across the subfloor members and attaching the flooring strips to the subfloor members.

20. The method of claim 19, wherein the top surface of the base of each subfloor member has an elongated slot formed therein for receiving the at least one pad.

21. The method of claim 20, further comprising the step of cutting slots in the lower surface of selected subfloor members so as to accommodate deformities in the substrate.

22. The method of claim 20, wherein the lower surface of the base of at least one of the subfloor members has an angled portion, the method further comprising placing a shim underneath the angled portion so as to adjust the height of said at least one of the subfloor members.

23. The method of claim 19, wherein the pad is made of a resilient material, and the base is made of wood.

* * * * *